US006702160B1

(12) United States Patent
Griffith

(10) Patent No.: US 6,702,160 B1
(45) Date of Patent: Mar. 9, 2004

(54) NO SPILL CONTAINER

(76) Inventor: H Russell Griffith, 601 E. Main St., Georgetown, KY (US) 40324

( * ) Notice: Subject to any disclaimer, the term of this patent is extended or adjusted under 35 U.S.C. 154(b) by 0 days.

(21) Appl. No.: 10/403,889

(22) Filed: Mar. 31, 2003

(51) Int. Cl.[7] ..... B67D 5/06

(52) U.S. Cl. ..... 222/510; 222/570; 222/518; 222/481.5; 222/484

(58) Field of Search ..... 222/570, 460, 222/462, 246, 365, 464.6, 461, 481.5, 518, 510, 548, 555, 484; 141/331, 332, 333, 327, 335, 337, 338, 339, 344, 345; 215/232, 303

(56) References Cited

U.S. PATENT DOCUMENTS

| | | | | | |
|---|---|---|---|---|---|
| 1,036,967 | A | | 8/1912 | Craven | |
| 1,313,174 | A | * | 8/1919 | Eisenhardt | 222/365 |
| 1,376,103 | A | | 4/1921 | Krogmann | |
| 4,082,163 | A | * | 4/1978 | Takeishi | 184/105.1 |
| 4,162,747 | A | * | 7/1979 | Graf | 222/484 |
| 4,189,072 | A | | 2/1980 | Conn | |
| 4,286,737 | A | * | 9/1981 | Gallant | 222/470 |
| 4,846,380 | A | | 7/1989 | Giuseppe | |
| 4,979,655 | A | | 12/1990 | Gallucci | |
| 5,123,570 | A | * | 6/1992 | Dubow et al. | 222/83 |
| 5,146,957 | A | | 9/1992 | Belokin, Jr. et al. | |
| 5,356,042 | A | | 10/1994 | Huffman et al. | |
| 5,395,000 | A | * | 3/1995 | Porter | 215/267 |
| 5,402,920 | A | | 4/1995 | Dhillon | |
| 5,464,133 | A | * | 11/1995 | Drummond | 222/484 |
| 5,518,050 | A | | 5/1996 | Dumas | |
| 5,692,652 | A | | 12/1997 | Wise | |
| 5,996,857 | A | | 12/1999 | Markos | |
| 6,045,013 | A | * | 4/2000 | Yang | 222/510 |
| 6,276,571 | B1 | | 8/2001 | Clemmons | |
| 6,311,877 | B1 | * | 11/2001 | Yang | 222/510 |

* cited by examiner

*Primary Examiner*—Gene Mancene
*Assistant Examiner*—Frederick Nicolas
(74) *Attorney, Agent, or Firm*—Michael I Kroll

(57) ABSTRACT

The invention discloses a no spill container where the user can properly position the dispensing port and release the contents of the container by means of a release assembly integral with the cap of a displacement port. The contents are released when the cap of the displacement port is rotated into an open position and the integral release stem lifts the sealing means that is adjoined to the stem on the opposite end at the dispensing port. The lifting of the stem causes the sealing means at the dispensing port to disengage from the dispensing port allowing the contents of the container to be expelled.

13 Claims, 8 Drawing Sheets

NO SPILL CONTAINER

BACKGROUND OF THE INVENTION

1. Field of the Invention

The present invention relates generally to dispensing containers and, more specifically, to construction of dispensing containers that allows for the dispensing of the contents without spilling.

The present invention allows the user to properly position the dispensing port prior to expelling the contents of the container. When the user has properly positioned the dispensing port and desires to release the contents of the container, the user releases the contents by opening a release cap on a displacement port on the opposite end of the container. The contents are released when the release cap is rotated into an open position. When the releasing port is opened, an adjoining stem that is submerged in the contents of the container, lifts a seal plug that is adjoined to the stem on the opposite end at the dispensing port. The lifting of the stem causes the seal plug at the dispensing port to withdraw therefrom while simultaneously opening the release port allowing the contents of the container to be expelled quickly and evenly as air entering the container from the displacement port displaces the fluid exiting the container.

2. Description of the Prior Art

There are other locking devices designed for no spill containers. Typical of these is U.S. Pat. No. 1,036,967 issued to J. F. Craven, on Aug. 27, 1912.

Another patent was issued to F. J. Krogmann, on Apr. 26, 1921 as U.S. Pat. No. 1,376,103. Yet another U.S. Pat. No. 4,189,072 was issued to John L. Conn, on Oct. 30, 1978 and still yet another was issued on Jul. 11, 1989 to James D. Giuseppe, as U.S. Pat. No. 4,846,380.

Another patent was issued to Daniel D. Gallucci on Dec. 25, 1990 as U.S. Pat. No. 4,979,655. Yet another U.S. Pat. No. 5,146,957 was issued to Paul Belokin, Jr. on Sep. 15, 1992. Another was issued to Terry Huffman on Oct. 18, 1994 as U.S. Pat. No. 5,356,042 and still yet another was issued on Apr. 4, 1995 to Sunny S. Dhillon as U.S. Pat. No. 5,402,920.

Another patent was issued to Marc Dumas on May 21, 1996 as U.S. Pat. No. 5,518,050. Yet another U.S. Pat. No. 5,692,652 was issued to Hector G. Wise on Dec. 2, 1997. Another was issued to J. Markos Charles on Dec. 7, 1999 as U.S. Pat. No. 5,996,857 and still yet another was issued on Aug. 21, 2001 to Kody Clemmons as U.S. Pat. No. 6,276,571.

U.S. Pat. No. 1,036,967

Inventor: J. F. Craven

Issued: Aug. 27, 1912

This invention relates to closures for receptacles for containing liquid, semi liquid, pastry or semi-solid substances, and more particularly to closures for oil can cans, grease guns and the like, which are adapted or intended for discharging the contents of the receptacle through a spout or a nozzle or grease cups of machines and the like.

The object of the present invention is to provide a closure for such receptacles so arranged that the act of attaching a removable spout to the receptacle operates the closure to open the discharge orifice, while the act of detaching the spout operates the closure to close the discharge orifice.

U.S. Pat. No. 1,376,103

Inventor: F. J Krogmann

Issued: Apr. 26, 1921

This invention relates to a dispensing can or receptacle and particularly to the construction of a can for dispensing of liquid or oil.

The object of the invention is the construction of a receptacle or can which can be easily filled or emptied, without injury to the can, and which can be susceptible of discharging the contents thereof of at least two sides.

U.S. Pat. No. 4,189,072

Inventor: John L. Conn

Issued: Feb. 19, 1980

Container with nozzle and/or drinking tube and closure means. The construction of a container with a closure means wherein the closure means assembly will serve as a nozzle; as a drinking tube; and as a closure means.

U.S. Pat. No. 4,846,380

Inventor: James D Giuseppe

Issued: Jul. 11, 1989

An elongated pouring spout is provided incorporating relatively rotatable inner and outer tubular members which are longitudinally shiftable and relatively rotatable relative to each other. The spout includes inlet and outlet ends and the outlet end of the outer tubular member is closed by an end wall and includes a plurality of peripherally spaced and radially outwardly opening ports formed therein adjacent the end wall. The outlet end of the inner tubular member is open and includes a beveled (innerside) end edge sealingly seatable in a circumferential groove formed in the inner surface of the end wall and the inlet end of the inner tubular member projects outward of the inlet end of the outer tubular member. Further, the inlet end of the spout defines a pin and slot connection between the inner and outer tubular members whereby relative rotational oscillation of the inner and outer tubular members will cause relative longitudinal reciprocation thereof.

U.S. Pat. No. 4,979,655

Inventor: Daniel D Gallucci

Issued: Dec. 25, 1990

A pouring assembly or fitment for pouring material from a container in an inverted position comprises a tube having a first end for attachment to the open end of the container and a second end having a dispensing opening for dispensing material from the tube, and a closure sleeve fitting over the second end of the tube and movable relative to the tube between a first position in which the dispensing opening is blocked and a second position in which the dispensing opening is open. The closure sleeve has a closed first end, a cylindrical portion extending from the first end for closely fitting over the second end of the tube, and an outwardly tapering conical portion extending from the cylindrical portion to the second end of the sleeve, which acts as a rest for positioning the assembly on oil fill openings of varying dimensions.

U.S. Pat. No. 5,146,957

Inventor: Paul Belokin, Jr. et al.

Issued: Sep. 15, 1992

A tapered liquid container which is nestable with other like empty containers and a collector for receiving empty containers in nested relationship. The container has a tapered side wall, a large bottom end, and a small top dispensing end. A closable large bottom opening and a closable small top opening is formed in the bottom and top ends, respectively. A bottom closure seals the bottom opening and is removable when dispensing the liquid. A top closure is provided for sealing the top opening and is removable to permit liquid to be emptied. The collector includes an upper portion having a tapered socket for receiving an inverted empty container body with the top and bottom closures removed to permit draining of residual liquid. The tapered socket holds the container securely to permit successive containers to be inserted into the open bottom end when the bottom closure is removed of a preceding container.

The containers are thus nested for consolidation and draining of residual liquid. A receptacle is provided for receiving and holding drained residual liquid.

The containers are thus nested for consolidation and draining of residual liquid. A receptacle is provided for receiving and holding drained residual liquid.

U.S. Pat. No. 5,356,042

Inventor: Terry Huffman

Issued: Oct. 18, 1994

A dispensing container for motor oil includes a conventional oil container which has an upwardly tapered top surface. A valve at the outlet and a valve stem is axially disposed in the container. The valve and valve stem have a bellowed actuating member disposed in an open cavity at the container bottom, which when depressed, opens the valve. A safety stem is provided on the valve stem which engages the tapered top surface for preventing the valve and valve stem from falling out of the container after the container has been opened and inverted.

U.S. Pat. No. 5,402,920

Inventor: Sunny S Dhillon

Issued: Apr. 4, 1995

A no spill container including a bottle having a threaded neck for attaching to a threaded cap. The cap includes a conical stopper and a flared skirt extending inward on the bottle. The inward end or hem of the skirt provides a gripping surface away from the neck of the bottle for opening and closing the cap. The neck includes an opening to receive the stopper when the cap is closed. An aperture is formed in the cap. When the cap is open, fluid in the container flows into the neck opening and is discharged from the aperture. When the cap is closed the stopper extends inside the neck opening and the outer end of the neck closes the aperture in the cap, to thereby prevent fluid flow out from the container.

U.S. Pat. No. 5,518,050

Inventor: Marc Dumas

Issued: May 21, 1996

A pouring device for pouring lubricating oil into the oil filler neck of a conventional engine. The pouring device is adapted to prevent unwanted spilling of oil onto the exterior surface of the engine block during the pouring operation. The pouring device has a cylindrical connecting neck portion which is adapted to be threadaly mounted over the discharge aperture of a conventional lubricating oil container. The connecting neck portion extends integrally into a spout. The spout has an inlet surface. A sealing membrane is hingely connected to the connecting neck portion, adjacent the inlet surface. The sealing membrane is adapted to pivot between a closed position wherein it prevents the lubricating oil from flowing through the inlet aperture and an open position wherein the sealing membrane allows the lubrificating oil to flow through the inlet aperture. The sealing membrane is adapted to be releasably locked in its close position by a locking lip which abuts against its peripheral edge. A biasing strip extends integrally from the sealing membrane. The biasing strip is adapted to create an initial biasing force which biases the sealing membrane against the locking lip. A trigger mechanism is attached to the biasing strip for selectively increasing the value of the initial biasing force to a level at which it will allow the sealing membrane to overcome the locking action of the locking lip on the sealing membrane and cause the sealing membrane to pivot into its open position. The trigger mechanism has a trigger lever which is adapted to abut against the exterior surface of the engine when the spout is pushed into the oil filler neck.

U.S. Pat. No. 5,692,652

Inventor: Hector G Wise

Issued: Dec. 2, 1997

A self-closing valve for use with a bottle which includes a body having a neck with an opening therein at one end, and a moveable base at the other, is provided. In general, the valve comprises a stopper for selective location in the opening of the neck of the bottle, and an elongate actuating arm for moving the stopper. One end of the elongate arm is connected to the base of the bottle, while the stopper is located at the opposite end. Means are provided for allowing the base of the bottle to move with respect to the body. Pressure on the base of the bottle thus causes upward movement of the elongate arm, which movement causes the stopper to be pressed outwardly from the opening in the neck of the bottle, thus allowing fluid to flow from the bottle. Biasing means cause the base of the bottle to return to its natural state upon removal of the pressure, which simultaneously causes the stopper to be retracted into the neck of the bottle, stopping fluid flow.

U.S. Pat. No. 5,996,857

Inventor: Charles J. Markos

Issued: Dec. 7, 1999

An improved container providing improved spill control for the pouring of contents, such as fluids, into a receptacle, and in a preferred embodiment for pouring motor oil into an automobile engine, in which a moveable spout having a dispensing tube and a sealing plate is movable from a first position in which the sealing plate seals an opening to the container and a second position which aligns the dispensing tube with the opening for communicating the contents from the container to a receptacle, such as an automobile engine, the sealing plate being of a length sufficient to cover the opening for being sealed and remaining within a perimeter of the top surface when moved to the second position.

U.S. Pat. No. 6,276,571

Inventor: Kody Clemmons

Issued: Aug. 21, 2001

A portable fluid dispensing system, such as for the transfer of fuel to a vehicle fuel tank that is convenient and safe. The system hereof includes a closed fluid containing chamber, having access means for fitting the chamber, air relief means, and a quantity regulating dispensing mechanism. The quantity regulating dispensing mechanism includes a pair of concentric tubular members, rotatable relative to one another, where such members feature a series of apertures or ports that may be aligned, through rotation of one of the members, to control the quantity of fluid to be dispensed at any given time, such as in increments of gallons.

While these locking devices may be suitable for the purposes for which they were designed, they would not be as suitable for the purposes of the present invention, as hereinafter described.

It is thus desirable to provide better economic means of construction for containers that allows dispensing of the contents without spilling. It is further desirable to improve on existing means to refill containers that dispense the contents without spilling.

SUMMARY OF THE PRESENT INVENTION

A primary object of the present invention is to construct a container that allows dispensing of the contents without spilling.

Another object of the present is to construct a container that allows means to regulate the rate of flow while dispensing of the contents without spilling.

Yet another object of the present invention is to construct a container that allows means to position the spout dispensing port prior to releasing the contents from the container.

Still yet another object of the present invention is to provide means to stop the flow of the contents while dispensing the contents of the container without repositioning the container.

A further object of the present invention is to construct a container that allows means to replenish the contents of the container.

A yet further object of the present invention is to construct a container that allows means to provide economic packaging of the container A still yet further object of the present invention is to construct a container that utilizes a releasing stem to remove the seal plug from the dispenser port allowing the contents of the container to be expelled.

Another object of the present invention is to construct a container that allows means to protect the releasing stem from being- broken from the releasing seal.

Additional objects of the present invention will appear as the description proceeds.

The present invention overcomes the shortcomings of the prior art by providing mechanical economic means to dispense and regulate the flow rate of the contents of a container without spilling. Additionally the present invention overcomes shortcomings of prior art by providing a container with opposed fluid displacement and dispensing ports.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF THE REFERENCED NUMERALS

Figure 1:
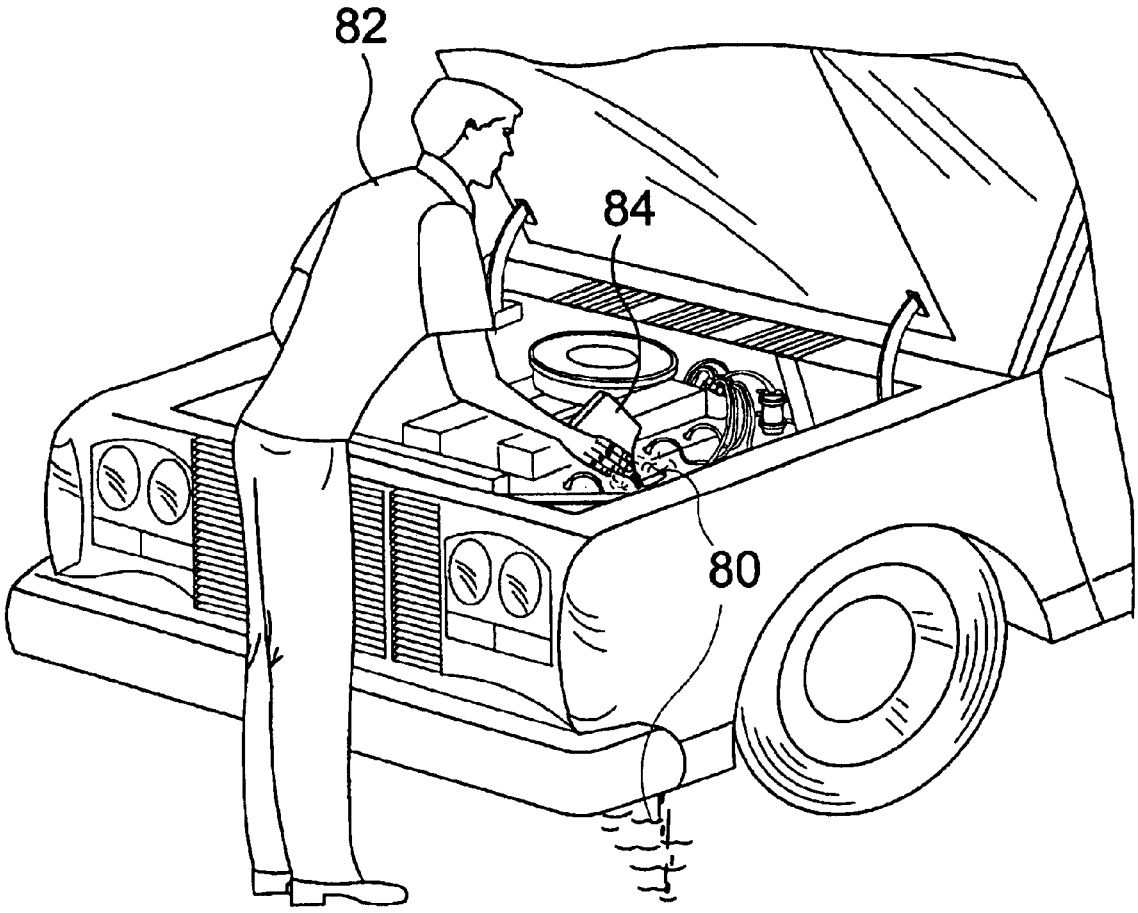
(PRIOR ART) FIG. 1
FIG. 1 is an illustrative view of prior art.

10 non-spill fluid dispensing container
12 housing member
14 dispensing port
16 displacement port
18 external sealing means of 14
20 internal sealing means of 14
22 external sealing means of 16
24 release stem
26 first end of 12
28 second end of 12
30 sidewall of 12
32 interior chamber of 12
34 interior wall of 14
36 exterior wall of 14
38 threads of 36
40 interior wall of 16
42 exterior wall of 16
44 threads of 42
46 cap of 14
48 threads of 46
50 release cap of 16
52 threads of 50
54 external sealing means of 14
56 internal sealing means of 14
58 external sealing means of 16
60 release mechanism
64 first end of 24
66 second end of 24
68 flared plug
70 cylindrical portion of 68
72 flared portion of 68
74 stop element
76 stop posts
78 spreader ring
80 fluid
82 user

84 container of prior art
86 refill port
88 sealing means of 86

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the prior art 80. FIG. 1 illustrates a common problem with pouring contents from a conventional container 84 while working within a confined space. It is difficult to get the container 84 in proper position prior to pouring the fluid 80 therein. Often the results include spilling of the fluid 80 outside the intended receptacle causing additional cleanup and anguish.

Figure 2:
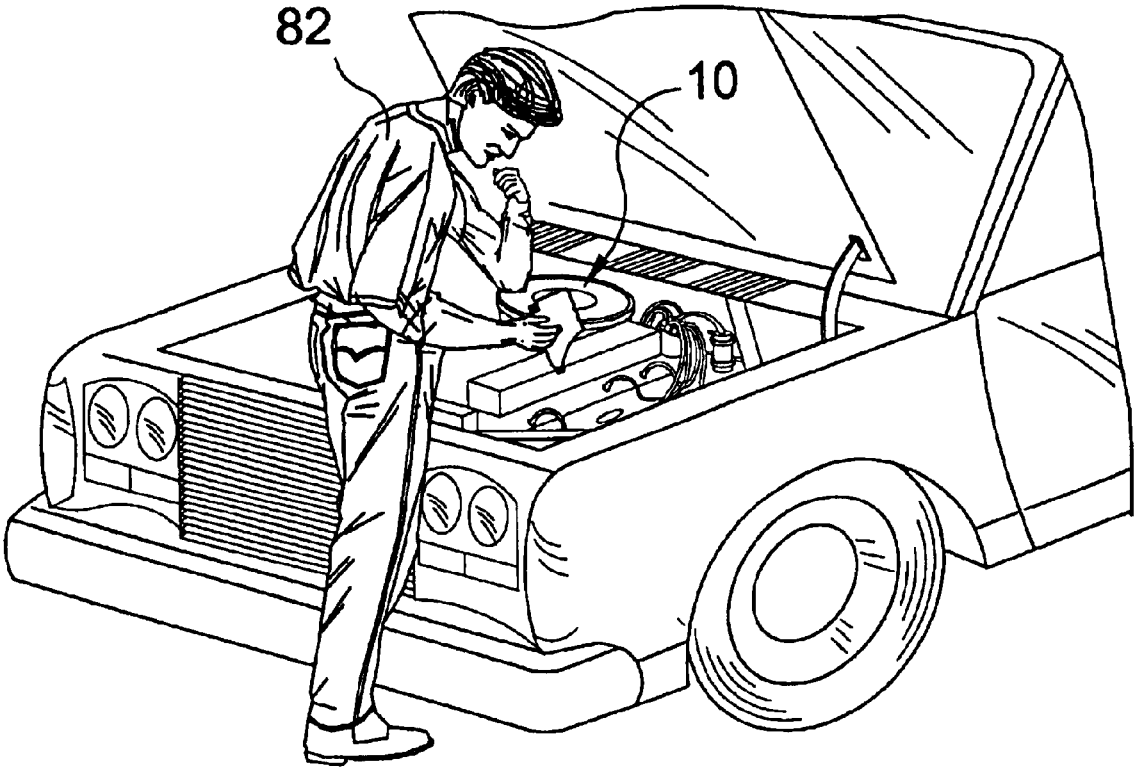
FIG. 2 is an illustrative view of the present invention.

Referring to FIG. 2, shown is an illustrative view of the present invention 10. FIG. 2 illustrates the user 82 preparing to pour the fluid 80 within the container 10 with ease and convenience. With an opposite end release mechanism 60, the container 10 is turned into pouring position without releasing the fluid 80. When the user 86 has properly positioned the container 10, the release mechanism 60 is applied by unscrewing the releasing cap 50. The releasing cap 50 in turn releases the interior seal 56 on the opposite end of the release mechanism 60 allowing the fluid 80 to be emptied.

Figure 3:
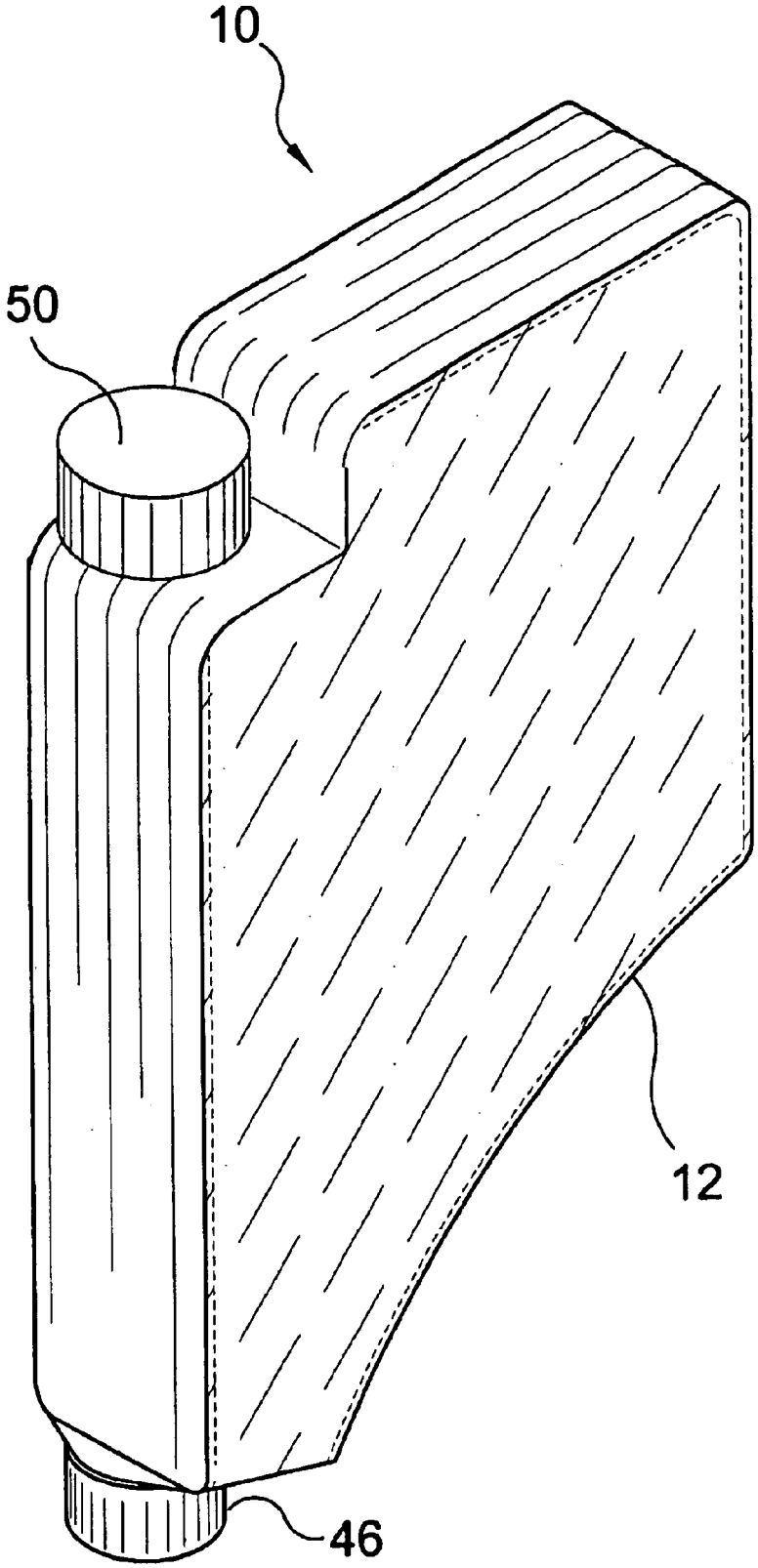
FIG. 3 is a perspective view of the present invention.

Referring to FIG. 3, shown is a perspective view of the no spill fluid dispensing container 10 of the present invention. The present invention 10 is used in a similar fashion as conventional containers 84 except that the dispensing port 14 remains sealed after the external sealing means 54 is removed thereby allowing the dispensing port 14 to be positioned prior to releasing the fluid 80 contained therein. Partially unscrewing the release cap 50 of the displacement port 16 provides for a slow controlled pour while fully removing the release cap 50 provides for a rapid, even flow.

Figure 4:
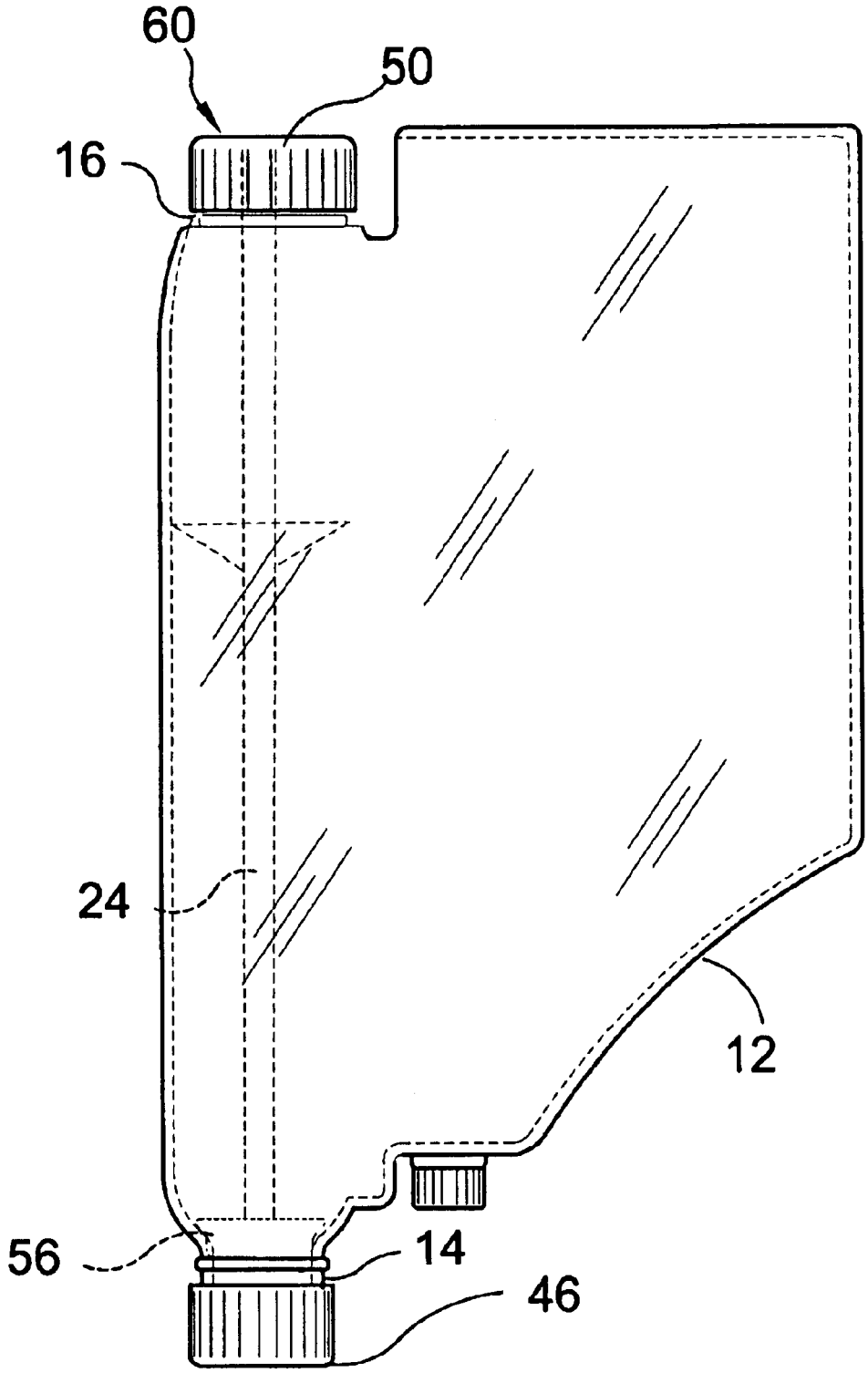
FIG. 4 is a front view of the present invention.

Referring to FIG. 4, shown is a front view of the no-spill container 10 in a closed position. The cap 46 of the dispenser port 14 and the release cap 50 are closed and the plug 68 of the release mechanism 60 is maintained firmly within the dispensing port 14 by the release stem 24 extending from the release cap 50.

Figure 5:
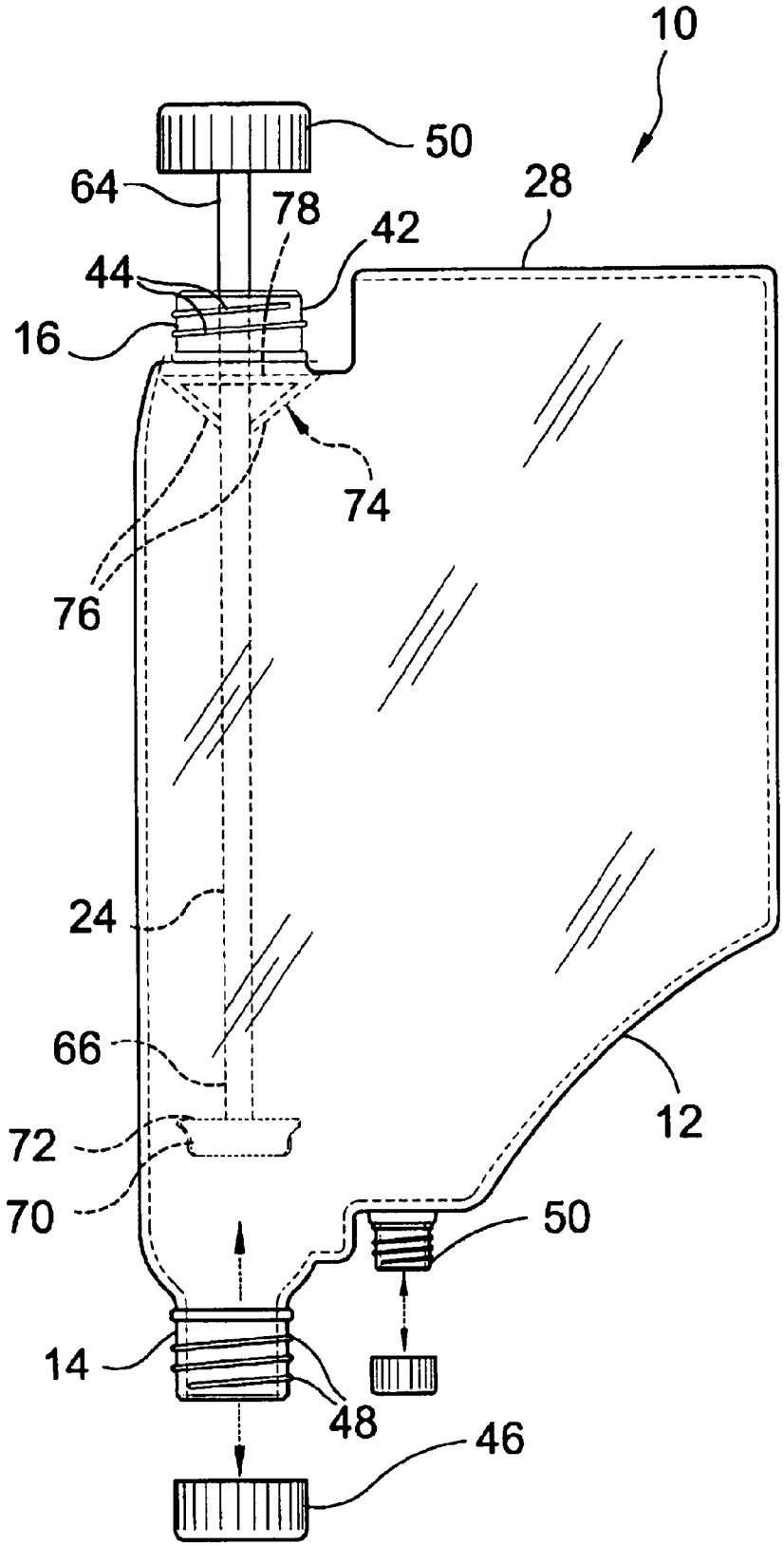
FIG. 5 is a front view of the present invention.

Referring to FIG. 5, shown is a front view of the present invention 10 having the dispensing cap 32, refill cap 88, the release cap 50 and the internal sealing means 56 open. Removal of the release mechanism 60 is refused by a stop element 74.

Figure 6:
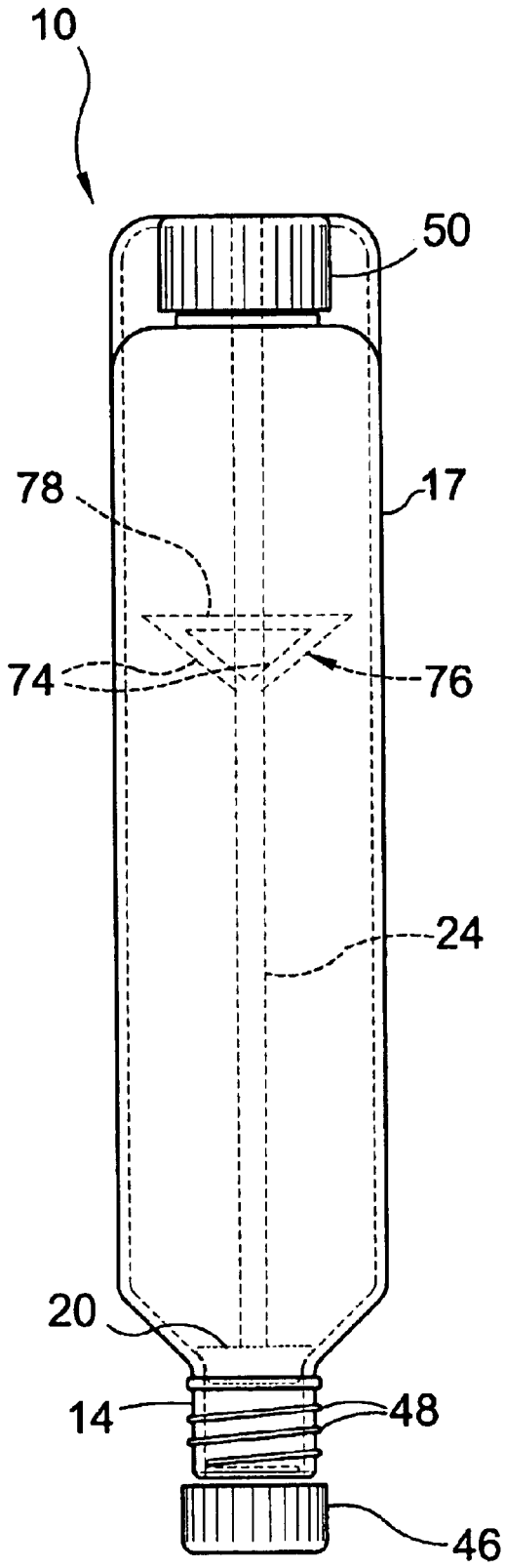
FIG. 6 is a side view of the present invention.

Referring to FIG. 6, shown is a side view of the no spill container 10 in a sealed position. The dispensing cap 46 can be removed without expelling the fluid 80 in the container thus allowing the user 82 to position the dispensing port 14 in a desired location prior to releasing the fluid 80 and eliminating the potential of accidental spillage. The refill port 86 provides access to the interior chamber 32 allowing additional means to add or expel the fluid 80 of the container 10.

Figure 7:
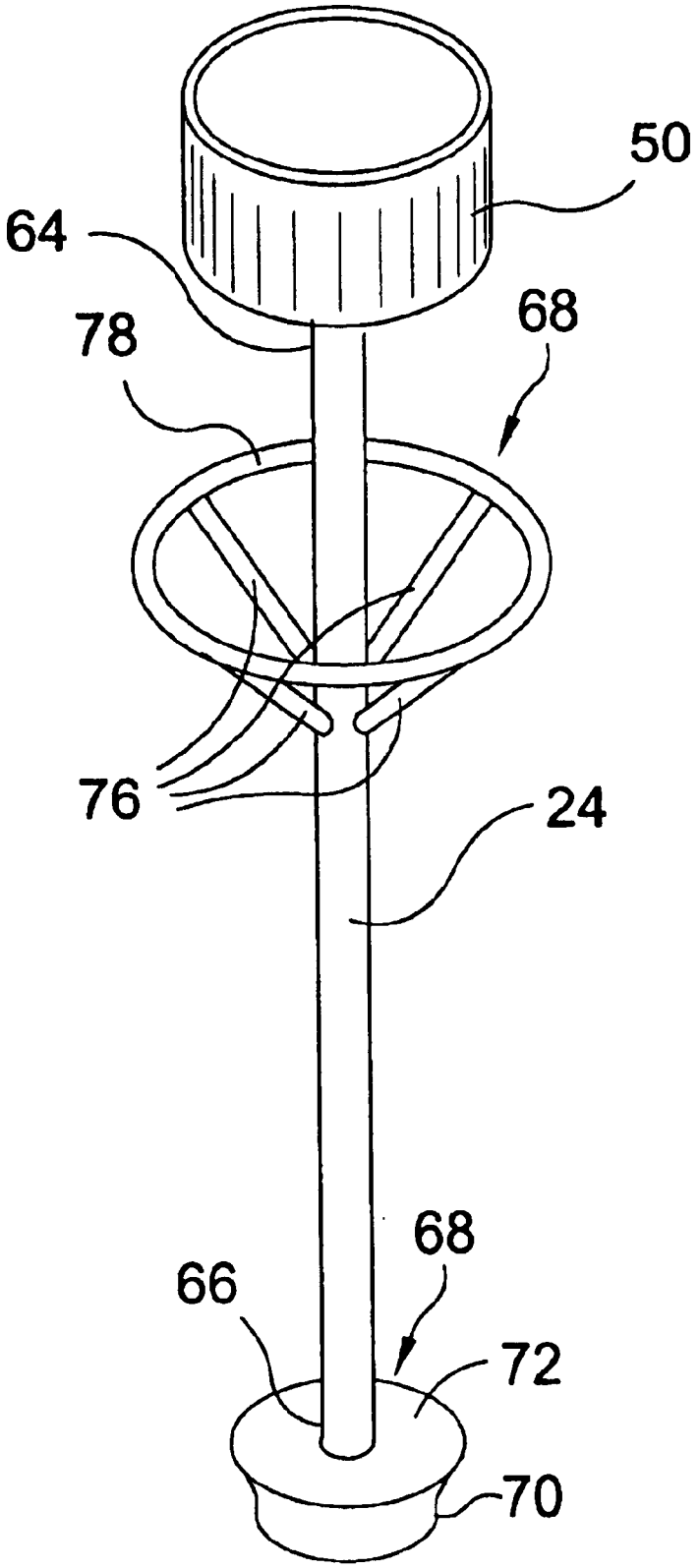
FIG. 7 is a perspective view of the stop.

Referring to FIG. 7, shown is a perspective view of the stop element 46. The flared plug 68 is sized to fit within the interior wall 34 of the dispenser port 14 and is maintained in place by pressure applied by the release stem 24 which is locked into placed by the closed release cap 50. When the release cap 50 is unscrewed the flared plug 68 is pulled away and allows fluid 80 to flow therethrough. The dispenser port 14 is slightly smaller than the displacing port 16 allowing for the easy insertion of the flared plug 68 into the interior chamber 32 while providing a tight seal in the dispensing port 14. The stop element 74 shown comprises a resilient spreader ring 78 having a plurality of stop posts 76 projecting angularly downward and pivotally connected to the release stem 24.

Figure 8:
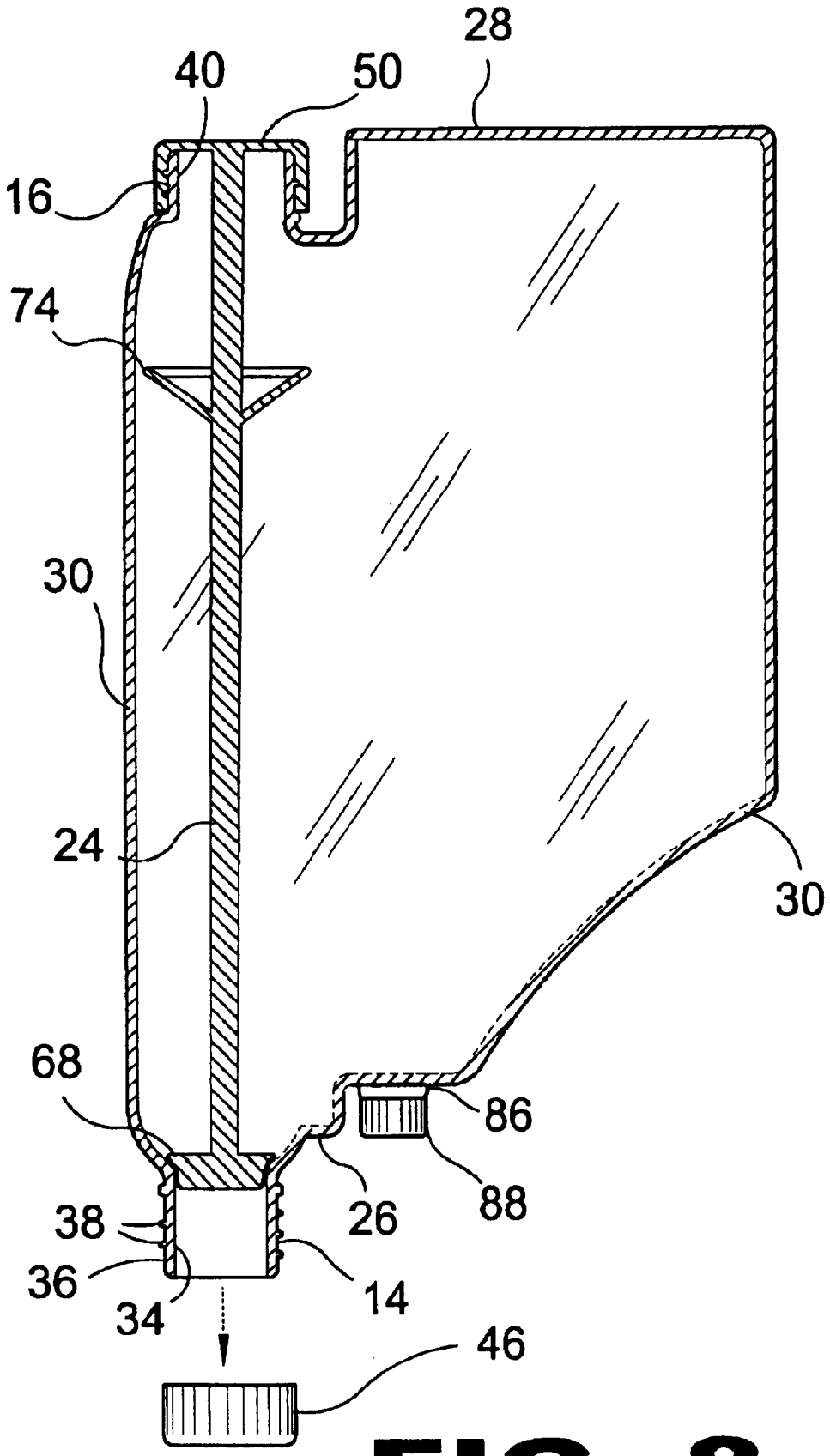
FIG. 8 is a front sectional view of the present invention.

Referring to FIG. 8, shown is a front sectional view of the no spill container 10. The dispensing cap 46 has been removed but the dispensing port 14 is still sealed because the release cap 50 remains secured to the displacement port 16 thus maintaining the flared plug 68 in a wedged position within the interior wall of the dispensing port 14. The release cap 50 may be removed once the container 10 is in place and ready to dispense the contents thereby pulling the associated release stem 24 and attached flared plug 68 to flow freely therethrough whilst simultaneously allowing air to enter the interior chamber 32 through the displacement port 16 in order to displace the exiting fluid 80 for a quick, smooth pour. A stop element 74 is included on the release stem 24 which flexes in one direction in order to allow for entry into the interior chamber 32 through the displacement port 16 when installing the release assembly 60 but will prohibit its removal therefrom.

What is claimed is new and desired to be protected by Letters Patent is set forth in the appended claims:

1. A no-spill fluid dispensing container comprising:

a) a housing member for containing a fluid therein including:
   i) a first end;
   ii) a second end;
   iii) peripheral sidewalls communicating between said first end said second end; and
   iv) an interior chamber as defined by said first end, said second end and said sidewalls;

b) a substantially cylindrical dispensing port extending from said first end of said housing member having an interior wall and an exterior wall;

c) a substantially cylindrical displacement port disposed on said second end of said housing member and having an interior wall with a diameter greater than that of said dispensing port and an exterior wall configured to provide 360 degree clearance therearound and extending even with the plane of said second end of said housing member to provide stability when said non-spill fluid dispensing container stands on said second end;

d) an external means for removably sealing said dispensing port;

e) an internal means for selectively sealing said dispensing port and controlling the flow of fluid therethrough; and f) an external means for removably sealing said displacement port; and g) a release mechanism comprising a rigid release stem having a first end integral with said external sealing means of said displacement port and a second end affixed to said internal sealing means of the dispenser port.

2. The no-spill fluid dispensing container as recited in claim 1, wherein said external means of sealing said dispensing port is a threaded cap that screws onto mating threads disposed upon said exterior wall of said dispensing port.

3. The no-spill fluid dispensing container as recited in claim 1, wherein said external means of sealing said displacement port is a threaded release cap that screws onto mating threads disposed upon said exterior wall of said displacement port.

4. The no-spill fluid dispensing container as recited in claim 1, wherein said internal means of sealing said dispensing port is a flared plug element wherein a substantial portion thereof is cylindrical and of a slightly smaller diameter than said interior wall of said dispensing port thus allowing said plug to easily be inserted therein and extracted therefrom while frictionally engaging the interior dispensing port wall, the flared portion of said plug serves to ensure the integrity of the seal.

5. The no-spill fluid dispensing container as recited in claim 1, wherein said release stem is of a sufficient length so as to fully insert said cylindrical portion of said plug and part of said flared portion into said dispensing port when said release cap is fully secured on said displacement port.

6. The no-spill fluid dispensing container as recited in claim 1, wherein said threaded cap of said dispenser port is removed prior to use and the dispenser port is turned downwards and positioned to pour the fluid therefrom although it is retained therein by said flared plug until said release cap on said displacement port is removed thereby lifting said release stem and retracting the associated flared plug to allow fluid to exit therefrom.

7. The no-spill fluid dispensing container as recited in claim 6, wherein the removal of said release cap simultaneously opens said dispenser port and said displacement port thereby allowing air to enter said interior chamber through said displacement port to displace the fluid exiting through said dispenser port to provide a rapid, even egress of said fluid.

8. The no-spill fluid dispensing container as recited in claim 6, wherein the fluid may be disbursed as a controlled trickle by slowly, but not fully, unscrewing said displacement cap thereby incrementally extracting said flared plug from said dispenser port and allowing a restricted amount of air to enter said interior chamber between the threads of said displacement port and said release cap with the egress of fluid increasing as said release cap is unscrewed and decreasing as it is tightened.

9. The no-spill fluid dispensing container as recited in claim 1, wherein said fluid dispensing container is disposable.

10. The no-spill fluid dispensing container as recited in claim 1, wherein said fluid dispensing container is reusable.

11. The no-spill fluid dispensing container as recited in claim 10, wherein said fluid dispensing container further includes a stop element to allow said flared plug and said release stem to be inserted into said interior chamber through said displacement port at the time of manufacture but would prohibit the removal thereof.

12. The no-spill fluid dispensing container as recited in claim 11, wherein said stop element comprises a plurality of rigid stop posts flexibly attached to said release stem and extending angularly therefrom towards said second end of said housing with the distal ends thereof connected to one another by a resilient spreader ring having a diameter greater than said displacement port allowing it to compress during insertion therethrough but would prohibit the removal thereof.

13. The no-spill fluid dispensing container as recited in claim 10, wherein said fluid dispensing container further includes a refill port adjacent said dispensing port having a means for selectively sealing said refill port.

* * * * *